US005277768A

United States Patent [19]

Twardowski

[11] Patent Number: 5,277,768

[45] Date of Patent: Jan. 11, 1994

[54] MEMBRANE CELL WASHING

[75] Inventor: Zbigniew Twardowski, Mississauga, Canada

[73] Assignee: Sterling Canada, Inc., Islington, Canada

[21] Appl. No.: 863,247

[22] Filed: Apr. 3, 1992

[51] Int. Cl.[5] ..... C25B 1/16

[52] U.S. Cl. ..... 204/101; 204/98; 204/151; 204/182.4; 204/131

[58] Field of Search ..... 204/182.4, 151, 131, 204/101, 98

[56] References Cited

U.S. PATENT DOCUMENTS 2,829,095 4/1958 Oda et al. ..... 204/98
4,081,520 3/1978 Swindells et al. ..... 423/478
4,439,293 3/1984 Vaughan ..... 204/151
4,465,658 8/1984 Fredette ..... 423/478
4,473,540 9/1984 Fredette ..... 423/478
4,627,969 12/1986 Fredette et al. ..... 423/478
4,636,288 1/1987 Vaughan ..... 204/182.4
4,684,453 8/1987 Vaughan ..... 204/182.4

*Primary Examiner*—John Niebling
*Assistant Examiner*—Arun S. Phasge
*Attorney, Agent, or Firm*—Sim & McBurney

[57] ABSTRACT

Scale is removed from within cation-exchange membranes by operating the cathode compartment of a cell divided by the cation-exchange membrane with a mildly-acid catholyte while effecting transfer of cationic species from the anode compartment to the cathode compartment.

4 Claims, 1 Drawing Sheet

SODIUM SESQUISULPHATE ELECTOLYSIS PLANT WITH PROVISIONS FOR "CURRENT ON" ACID WASHING.
A- ANODE
C- CATHODE
M- CATION EXCHANGE MEMBRANE

SODIUM SESQUISULPHATE ELECTOLYSIS PLANT
WITH PROVISIONS FOR 'CURRENT ON' ACID WASHING.
A- ANODE
C- CATHODE
M- CATION EXCHANGE MEMBRANE

MEMBRANE CELL WASHING

FIELD OF INVENTION

The present invention is concerned with washing of membrane cells, and, in particular, the rapid and effective removal of scale.

BACKGROUND TO THE INVENTION

All electrochemical cells, particularly those equipped with a cation-exchange membrane, suffer from a problem of hardness scale formation on or inside the membrane, as well as on the cathodes. The scale typically consists of hydroxides, carbonates, sulphates and silicates of calcium, magnesium, strontium, iron, manganese, chromium and other heavy metals. It is common practice to acid wash the cell interior to remove the scale during periodic shutdown of the cell and, typically, a 2 to 10% HCl solution is employed for this purpose. To effectively remove scale deposits from inside the membrane, at least one hour, and often longer, acid exposure is required, since both acid penetration and removal of dissolved scale occur by diffusion, an inherently-slow process.

A further disadvantage of the commonly-used acid treatment process is that all cell components made of mild steel, such as the cathode compartment and the cathode itself, undergo severe corrosion during the procedure. When the cathode is in the form of a low mass/high surface area structure, such as expanded mesh or screen, undesired dimensional changes resulting from the corrosion may be significant.

SUMMARY OF INVENTION

It now has surprisingly been found that rapid and effective removal of scale, particularly from cation-exchange membranes, can be achieved under much milder acidic conditions while, at the same time, permitting normal cell operation in the anode compartment to continue substantially unimpeded.

Accordingly, in one aspect, the present invention provides a method of removing scale from within a cation-exchange membrane in an electrochemical cell, which comprises passing an anolyte containing alkali metal ions through an anode compartment of the cell and providing acidic conditions therein, and passing acid catholyte having a pH no greater than about 6 through a cathode compartment of the cell separated from the anode compartment by said cation-exchange membrane. The anolyte and catholyte are electrolyzed to cause alkali metal ions to pass through the cation-exchange membrane and effect displacement of scale-forming cations from the membrane.

The procedure of the invention relies on the current-driven flux of alkali metal, usually $Na^+$, and $H^+$ ions from the anolyte through the cation-exchange membrane and the mildly acidic conditions present in the cathode compartment to effect scale removal. The scale deposits present in the cathode compartment and the cation-exchange membrane dissolve rapidly under the prevailing acidic conditions and the hardness cations electromigrate from the cation-exchange membrane to the cathode compartment under the influence of the electric field.

Since the procedure does not rely on diffusion of acid through the membrane, as in the current practice, as outlined above, there may be employed a mildly acid solution as the catholyte during the process, which serves to minimize corrosion of mild steel components. In addition, while the current remains on, the cathode is cathodically protected from corrosion by the mildly-acidic catholyte. The washing step effected by the process of the invention is rapid and effective and further does not interfere with the electrolytic operation in the anode compartment. Once the membrane washing operation is complete, the cathodic operation of cell may be reverted to production of alkali.

GENERAL DESCRIPTION OF INVENTION

Figure 1:
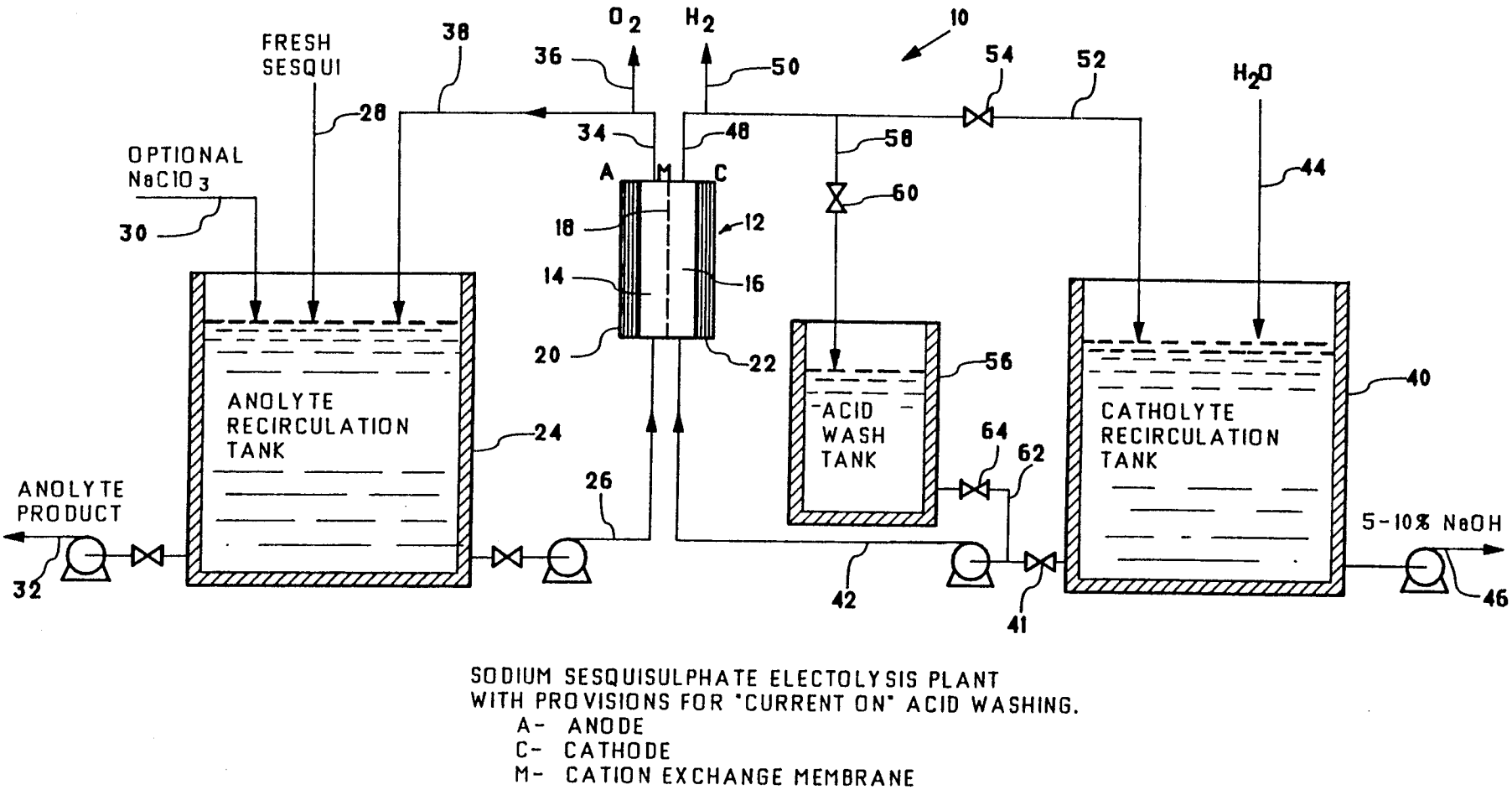
FIG. 1 is a flow sheet of the application of the acid washing operation of the present invention to a particular electrochemical operation using a cation-exchange membrane.

In copending U.S. patent application Ser. No. 535,165 filed Jun. 18, 1990 (now U.S. Pat. No. 5,122,240) assigned to the assignee hereof and the disclosure of which is incorporated herein by reference, there is described an electrochemical process for acidifying an alkali metal salt solution by passing an aqueous solution of an alkali metal chlorate, such as sodium chlorate, or of an alkali metal sulfate, such as sodium sesquisulfate, or preferably of both, to the anode compartment of a cell divided by a cation-exchange membrane into an anode and a cathode compartment.

In the cell, hydrogen ions are formed in the anode compartment to provide acidic conditions therein, while sodium ions along with some hydrogen ions are transferred across the cation-exchange membrane to the cathode compartment. Hydroxyl ions are generated in the cathode compartment, forming alkali metal hydroxide with the transferred alkali metal ions in that compartment. An acidified solution of alkali metal salts results from the anode compartment and may be forwarded to a chlorine dioxide generating reactor, while an aqueous alkali metal hydroxide solution results from the cathode compartment.

Generally, the cation-exchange membrane is alkaline throughout its thickness, except at the very anode face, which facilitates hardness scale formation within the cation-exchange membrane by scale-forming cations, such as $Ca^{2+}$, $Mg^{2+}$, $Sr^{2+}$ and $Fe^{3+}$, present in the anolyte or catholyte. Such scale formation impedes the flow of cathodic ionic species from the anode compartment to the cathode compartment and, as such scale builds up within the membrane, decreases the overall current efficiency and increases the cell voltage.

In accordance with the present invention, when descaling of the cation-exchange membrane is required, the normal alkaline catholyte is replaced by a mildly acidic catholyte, having a pH no more than about 6, preferably about 0 to about 3. No change is made to the feed to the anode compartment, so that the desired acidification process continues in the anode compartment during the descaling operation.

The presence of the mildly acidic catholyte in the cathode compartment, combined with the continued flux of cationic species from the anode compartment to the cathode compartment through the cation-exchange membrane results in the cation-exchange membrane rapidly becoming acidic throughout, as the alkali content of the membrane is neutralized by the current driven flux of $Na^+$ and $H^+$ ions through the membrane.

As the cation-exchange membrane becomes acidic, the scale deposits present in the cation-exchange membrane rapidly dissolve and the solubilized hardness cations then migrate from the cation-exchange membrane into the cathode compartment under the influence of the electric field.

Once the scale has been removed from the cation-exchange membrane, the passage of the acidic catholyte is ceased and normal cathode compartment operation is resumed to form sodium hydroxide solution. The mildly-acidic conditions also serve to remove scale build up within the cathode compartment.

Any convenient acid may be used as the catholyte during the acid wash of the present invention, provided that mildly acid conditions prevail and the pH of the catholyte does not exceed about 6. Preferably, about 0 to about 3. One particularly convenient form of acid which can be employed is sodium sesquisulfate, since this chemical often is available as the by-product of the chlorine dioxide generating operation to which the acidified sodium chlorate solution is fed from the anode compartment of the cell.

DESCRIPTION OF PREFERRED EMBODIMENT

Referring to the drawing, there is illustrated schematically therein a sodium sesquisulfate electrolysis plant 10 which has been modified for membrane acid washing in accordance with one embodiment of the invention. A membrane cell 12 comprises an anode compartment 14 and a cathode compartment 16 divided by a cation-exchange membrane 18. An anode 20 is positioned in the anode compartment 14 while a cathode 22 is positioned in the cathode compartment 16.

Liquor from an anolyte recirculation tank 24 is pumped by line 26 to the anode compartment 14. The anolyte recirculation tank 24 receives a feed of fresh sodium sesquisulfate by line 28, such as crystalline sodium sesquisulfate from a high acidity chlorine dioxide generation process, such as the so-called "R8" process as described in U.S. Pat. Nos. 4,081,520, 4,465,658, 4,473,540 and 4,627,969, assigned to the assignee hereof and the disclosures of which are incorporated herein by reference. Sodium chlorate also may be fed by line 30 to the anolyte recirculation tank 24. Anolyte product, comprising an acidified sodium sulfate and, when fed by line 30, sodium chlorate solution, is removed from the recirculation tank 24 by line 32.

In the anode compartment 14, the anolyte is electrolyzed to acidify the same, while sodium ions are transferred from the anode compartment 14 to the cathode compartment 16 across the cation-exchange membrane 18. The acidified solution is removed from the anode compartment 14 by line 34 and, after venting gaseous oxygen produced in the anode compartment 14 by line 36, is recirculated by line 38 to the anolyte recirculation tank 24.

Normally, liquor from a catholyte recirculation tank 40 is pumped through valve 41 and by line 42 to the cathode compartment 16. Water is fed to the catholyte recirculation tank 40 by line 44. Catholyte product, comprising an aqueous sodium hydroxide solution, which may have any desired concentration, such as from about 5 to 10 wt % NaOH, is removed from the catholyte recirculation tank by line 46.

In the cathode compartment 16, the catholyte is electrolyzed to form sodium hydroxide from hydroxyl ions formed at the cathode and the sodium ions transferred through the cation-exchange membrane 18 from the anode compartment 14. The sodium hydroxide solution is removed from the cathode compartment 16 by line 48 and, after venting gaseous hydrogen produced in the cathode compartment 16 by line 50, is recirculated by line 52 through valve 54 to the catholyte recirculation tank 40.

An acid wash tank 56 containing suitable mildly acidic medium, such as an aqueous solution of sodium sesquisulfate, is included in the catholyte circulation loop connected with an inlet line 58 having a valve 60 therein upstream of the valve 54 in the recirculation line 52 and with an outlet line 62 having a valve 62 therein downstream of the valve 41.

During normal cell operation, valves 41 and 54 are open while valves 60 and 64 are closed. When it is desired to effect descaling of the cation-exchange membrane 18, valves 41 and 54 are closed and valves 60 and 64 are opened, so that the aqueous acid solution is fed by line 42 to the cathode compartment 16 and circulates back to the acid wash tank 56 by lines 48 and 58.

Acid circulation is continued until the descaling operation is complete, at which time the valves 60 and 64 are closed and valves 41 and 54 are reopened to re-establish production of sodium hydroxide product. While descaling operation is effected, the operation of the anode compartment 14 is unchanged and anolyte product production continues.

SUMMARY OF DISCLOSURE

In summary of this disclosure, the present invention provides a novel electrochemical method of effecting acid descaling of cells, particularly for the removal of scale deposited in cation-exchange membranes, which is rapid and effective and yet uses mildly acidic conditions, so that corrosion of mild steel components of the cathode compartment is minimized. Modifications are possible within the scope of the invention.

What I claim is:

1. A method of operating an electrochemical cell comprising an anode compartment, a cathode compartment and a cation-exchange membrane separating said anode compartment from said cathode compartment, which comprises:

A. during a normal operation phase:

(i) passing an aqueous solution of alkali metal salt selected from the group consisting of an alkali metal sulfate, an alkali metal chlorate and a mixture of the two alkali metal salts to said anode compartment of the cell while passing an aqueous electrolyte to the cathode compartment of the cell, (ii) electrochemically forming hydrogen ions in said anode compartment while transferring alkali metal ions from the anode compartment through said cation-exchange membrane to said cathode compartment and electrochemically forming hydroxyl ions in said cathode compartment to provide alkaline conditions therein, and (iii) removing an acidified aqueous solution of alkali metal salt from said anode compartment and removing an alkali metal hydroxide solution from said cathode compartment, whereby said alkaline conditions in said cathode compartment result in scale formation in said cation-exchange membrane and in said cathode compartment; and B. during a regeneration operation phase:

(i) continuing to pass said aqueous solution of alkali metal salt to said anode compartment, continuing to form hydrogen ions in said anode compartment and transferring alkali metal ions from said anode compartment to said cathode compartment and continuing to remove an acidified aqueous solution of alkali metal salt from said anode compartment, and (ii) passing an acid catholyte having a pH no greater than about 6 to the cathode compartment of the cell to provide acidic conditions therein while simultaneously dissolving hardness cations from said cation-exchange membrane and within said cathode compartment and thereby solubilizing scale therein at least until said scale has been substantially removed.

2. The method of claim 1 wherein said aqueous alkali salt solution is an aqueous solution of sodium chlorate and sodium sesquisulfate and said alkali metal hydroxide solution is sodium hydroxide solution.

3. The method of claim 1 wherein said acid catholyte is an aqueous solution of sodium sesquisulfate.

4. The method of claim 1 wherein said acid catholyte has a pH of about 0 to about 3.

* * * * *